US005090295A

United States Patent [19]

Cunningham et al.

[11] Patent Number: 5,090,295

[45] Date of Patent: Feb. 25, 1992

[54] RADIAL PISTON ENGINE

[75] Inventors: Sinclair Cunningham, Kinghorn, Scotland; Peter Wüsthof, Lohr, Fed. Rep. of Germany

[73] Assignee: Mannesman Rexroth GmbH, Lohr, Fed. Rep. of Germany

[21] Appl. No.: 536,274

[22] Filed: Jun. 11, 1990

[30] Foreign Application Priority Data

Jun. 14, 1989 [DE] Fed. Rep. of Germany ..... 3919456

[51] Int. Cl.[5] ..... F01B 1/06; F04B 49/02; F15B 15/26

[52] U.S. Cl. ..... 91/491; 417/273; 417/214; 92/23

[58] Field of Search ..... 92/23, 72, 178, 22, 92/28, 30; 91/491, 492, 497, 498; 417/273, 214, 462

[56] References Cited

U.S. PATENT DOCUMENTS

| | | | |
|---|---|---|---|
| 3,338,141 | 8/1967 | Ramsay | 92/30 |
| 3,386,065 | 5/1968 | Algino | 92/30 |
| 3,741,685 | 6/1973 | Simko | 417/214 |
| 3,913,455 | 10/1975 | Green et al. | 91/492 |
| 3,978,771 | 9/1976 | Burnight et al. | 91/491 |
| 3,999,465 | 12/1976 | Burnight | 91/498 |
| 4,469,012 | 9/1984 | Bigo et al. . | |
| 4,716,816 | 1/1988 | Falt . | |
| 4,747,339 | 5/1988 | Wusthof et al. . | |

FOREIGN PATENT DOCUMENTS

| | | |
|---|---|---|
| 1653587 | 5/1972 | Fed. Rep. of Germany . |
| 2417348 | 10/1974 | Fed. Rep. of Germany . |
| 2920588 | 11/1979 | Fed. Rep. of Germany . |
| 3531632 | 3/1987 | Fed. Rep. of Germany . |
| 1425800 | 12/1965 | France . |
| 2204228 | 5/1974 | France . |
| 2224647 | 10/1974 | France . |
| 2243350 | 4/1975 | France . |
| 2289722 | 5/1976 | France . |
| 1055119 | 1/1967 | United Kingdom . |
| 1533457 | 11/1978 | United Kingdom . |
| 2128265 | 4/1984 | United Kingdom . |

*Primary Examiner*—Richard A. Bertsch
*Assistant Examiner*—Peter Korytnyk
*Attorney, Agent, or Firm*—Cushman, Darby & Cushman

[57] ABSTRACT

The invention relates to a radial piston engine, particularly a radial piston motor comprising a cylinder block within which a plurality of pistons and rollers are reciprocally mounted for cooperation with a cam path provided by a cam disc. Detent means are used to releasably locate the cylinders and rollers in a position corresponding with the lower dead point position of the pistons.

6 Claims, 4 Drawing Sheets

RADIAL PISTON ENGINE

FIELD OF THE INVENTION

This invention relates to a radial piston engine. More specifically the invention relates to a radial piston motor.

BACKGROUND OF THE INVENTION

Radial piston engines are used in many areas of industry. For instance, they are used in the form of radial piston motors as a drive means for vehicles. If a vehicle is equipped with drive means in the form of radial piston motors comprising pistons in engagement with a cam surface it is necessary to interrupt the engagement between said pistons and the cam surface, and to fixedly locate the pistons in their lower dead point position in case that the vehicle is to be towed with a relatively high speed. There are different ways to provide for the fixation of the pistons in that dead point position.

It is, for example possible to subject the housing of the radial piston motor to a slight overpressure (for instance 1 bar). Provided that the inlet and outlet of the pistons are without pressure, the pistons will be moved inwardly due to the overpressure existing within the housing, and, as a consequence the pistons are completely separated from the cam curve which is provided on a cam disc. Thus, the shaft of the motor and the cylinder block mounted thereon can freely rotate (including the pistons which are located in that cylinder block), i.e. the desired free running function is achieved. However, to provide for the overpressure within the housing, an auxiliary pump is necessary to create that pressure and further, valve means are required, with the consequence that undesirable costs are encountered.

U.S. Pat. No. 4,469,012 discloses for a hydraulic motor a connection between its pistons by means of a spring. Spring forces will tend to pull the pistons into their lower dead point position. This design requires substantial structural elements as well as space for said springs which are located outside of the cylinder block. Moreover, relatively large spring biasing forces are necessary to maintain the pistons in their lowest position within the cylinder block. A similar design is also shown in the German laid open application 29 20 588. Further, German laid open application 24 17 348 discloses an annular spring. (Said laid open application 24 17 348 claims the following priority: Great Britain, Apr. 9, 1973, Serial Number 16895-73). U.K. patent application 2 128 265 A discloses an hydraulic motor or pump, wherein radial pistons are adapted to be returned to a retracted position inside their cylinders by springs. German laid open application 16 53 587 discloses another hydraulic motor. U.S. Pat. No. 4,716,816 discloses a hydraulic motor using a spring for pressing the piston into an inside position.

SUMMARY OF THE INVENTION

It is an object of this invention to provide a radial piston engine and, specifically, a radial piston motor such, that a free running condition for the engine or motor can be achieved in an efficient manner. It is another object of the invention to provide simple structural means for arriving at said free running condition. It is a further object of the invention to provide means for obtaining the free running condition of the engine such that a low amount of space is required.

In accordance with another object of the invention a radial piston engine, in particular a radial piston motor, is provided such, that a safe and consistent operation as well as a long operating life is assured.

According to a feature of this invention a radial piston engine, specifically a radial piston motor, is provided which comprises a housing to which a cam disc is fixedly mounted. A cylinder block is mounted for rotation about an axis with respect to said cam disc. A plurality of bores extend radially with respect to said axis of rotation of the cylinder block. Pistons are arranged in each of said bores and cylindrical rollers allow said pistons to be supported by the cam surface of said cam disc. Said cylindrical rollers have axes which extend parallel to the axis of rotation of said cylinder block. Detent means are provided, which are adapted to provide for an engagement or a snap-in or detent action of said pistons within said cylinder block. Said means providing for said engagement or snap-in action are referred to as detent means.

Preferably said detent means is arranged such that it acts between said rollers and the cylinder block. It is preferred that said detent means act between the front surfaces of said rollers and the cylinder block. The detent means preferably act between the front surfaces of said rollers and those parts of the cylinder block which provide guidance for said rollers. According to another feature of this invention said detent means comprise spring loaded detent balls located in each roller. Further recesses are provided in those parts of the cylinder block which serve for the guidance of the rollers. Said recesses allow a snap-in action of said detent balls.

Preferably, said bores are adapted to receive said detent balls. Preferably, the recesses for the snap-in action of the detent balls are arranged at locations of the cylinder block such, that the rollers will be positioned in their respective lower dead point position.

A DETAILED DESCRIPTION OF THE DRAWINGS

Figure 7:
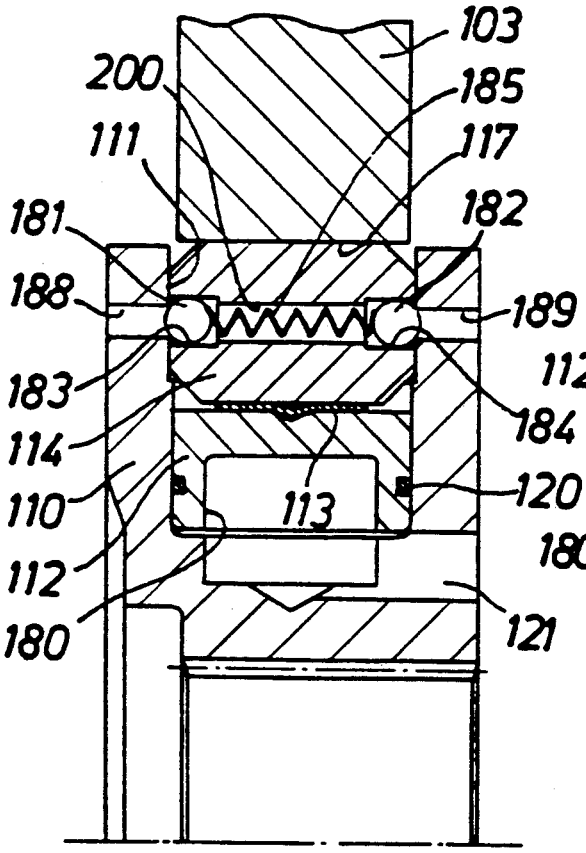
FIG. 7 is a sectional view similar to FIG. 6, however with one piston and roller in the respective lower dead point positions, with the roller being shown in its snap-in or detent position.
Figure 6:
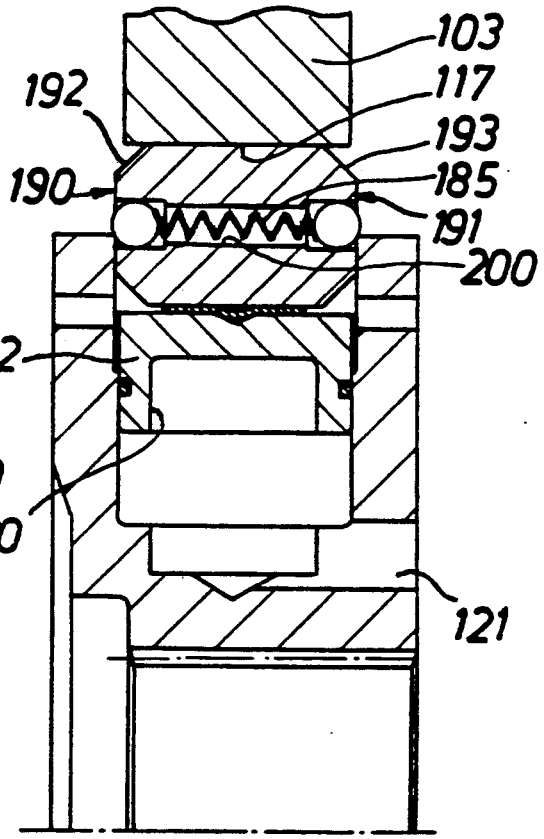
FIG. 6 is an embodiment of the invention in a representation similar to FIG. 4 with the piston and roller being shown in the upper dead point position.

Prior to the explanation of the invention as shown in FIGS. 6 and 7, a radial piston engine of the prior art will be explained.

Figure 1:
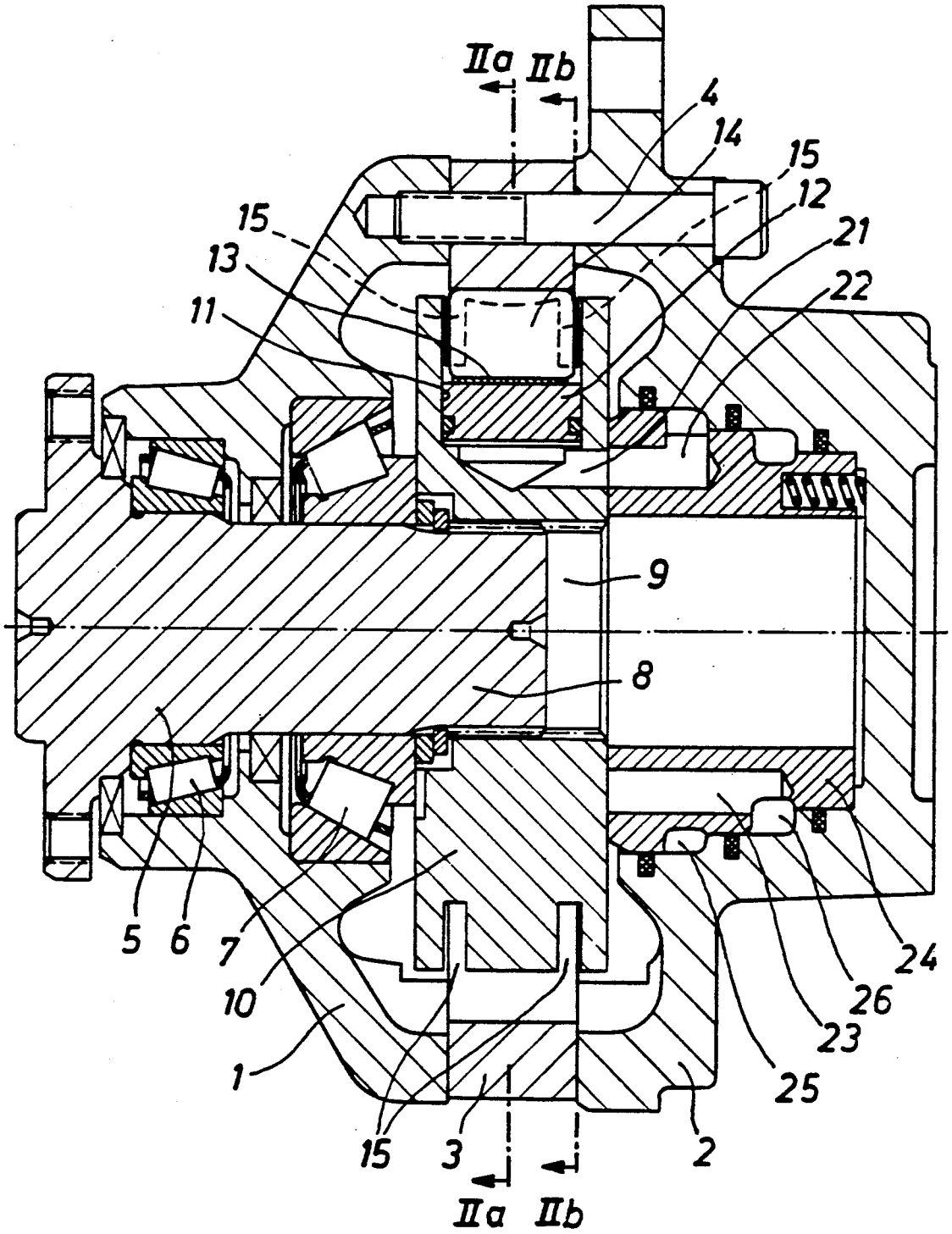
FIG. 1 is an axial longitudinal sectional view of a radial piston engine of the prior art as shown in German laid open application 35 31 632.
Figure 2:
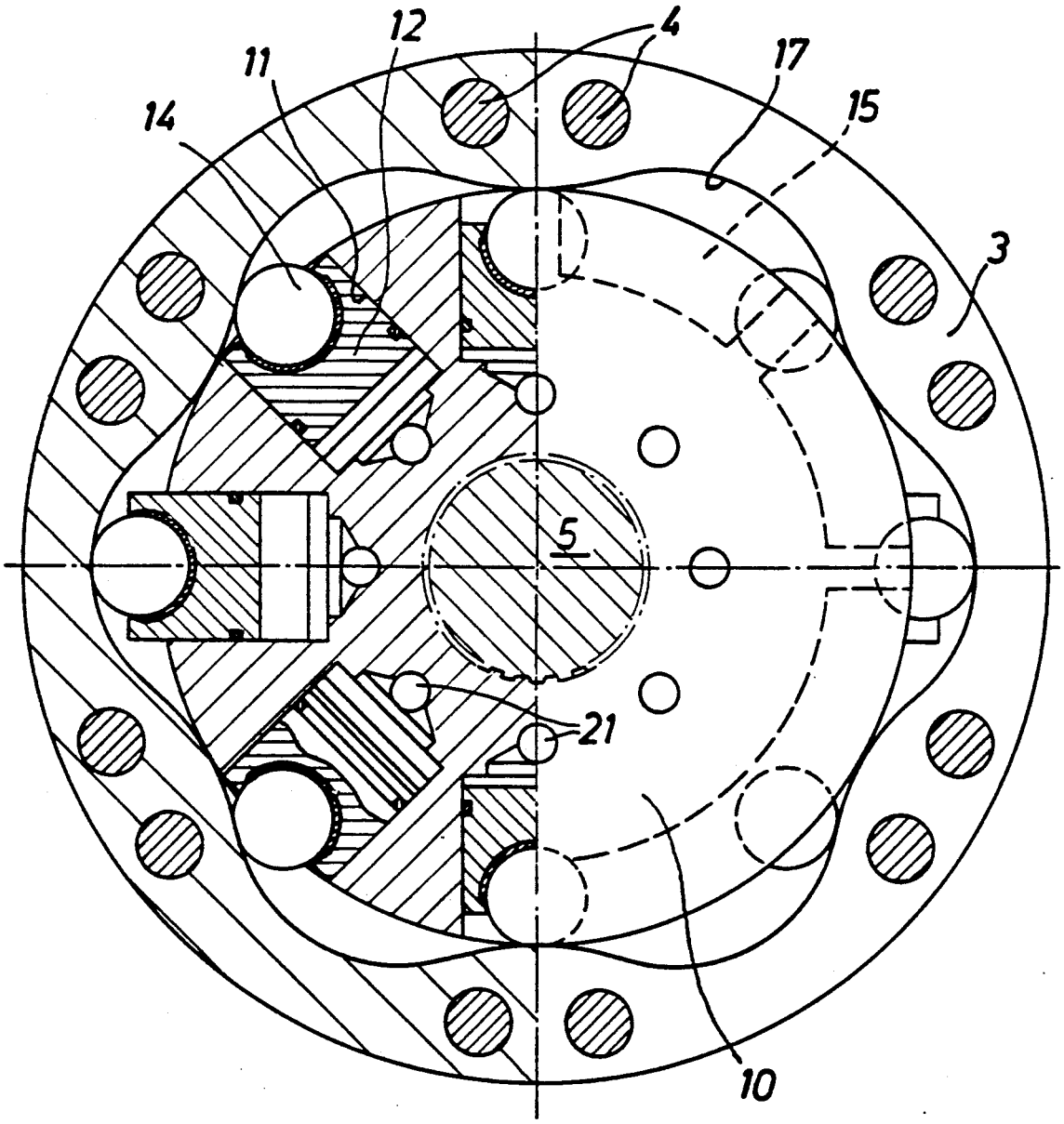
FIG. 2 is the left half of a sectional view along line IIa and the right half of a sectional view along line IIb in the FIG. 1.
Figure 3:
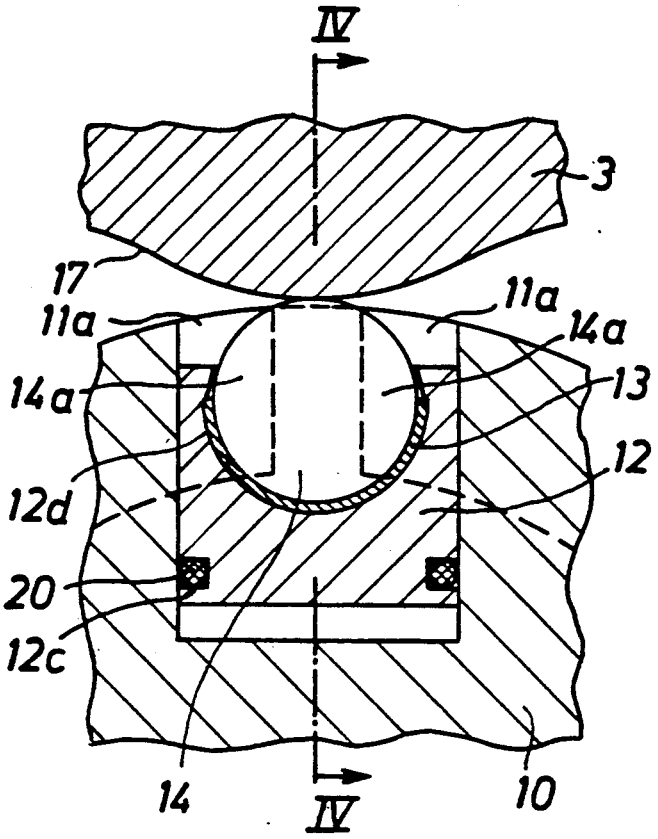
FIG. 3 is a more detailed partial sectional view of the engine shown in FIG. 2.
Figure 4:
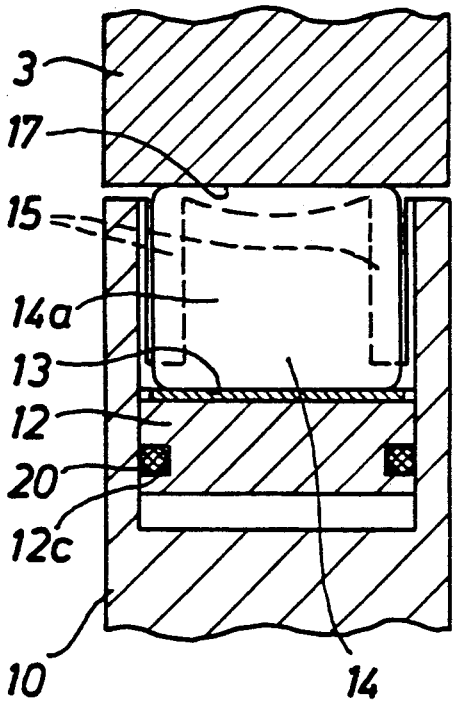
FIG. 4 is a sectional view along line IV—IV in FIG. 3.
Figure 5:
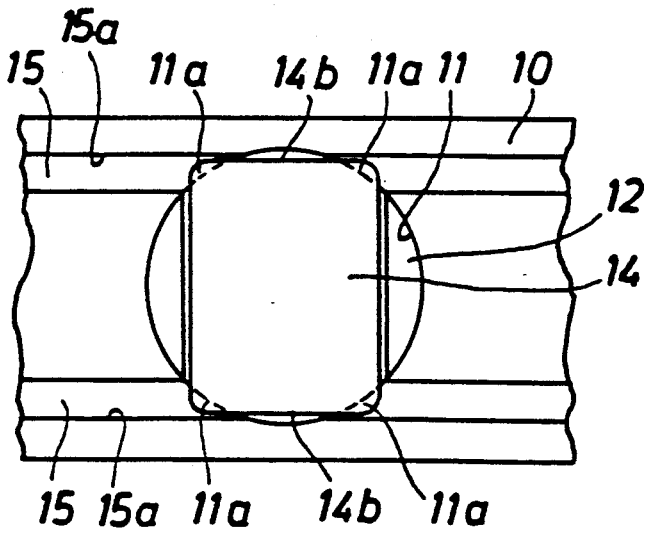
FIG. 5 is a plan view of the piston and a roller of FIG. 3.

In FIG. 1 a hydralic piston engine is shown which is preferably used as a pump. The engine comprises a housing consisting of two halfs, a housing half 1 and a housing half 2. Between said two housing halfs 1, 2, a cam disc 3 is located. By means of mounting bolts the two housing 1, 2, halfs and a cam disc 3 are united together to form a solid unit. Within the housing half 1 a shaft 5 is rotatably mounted by means of ball bearings 6 and 7. The end 8 of the shaft ending within the housing is provided with a plurality of grooves adapted to fixedly support a rotor 10 by means of a recess 9 provided in said rotor 10. The rotor 10 is designed as a cylinder block and is provided with bores 11 (see FIG. 2) which are evenly distributed about the circumference of the rotor 10. The bores 11 receive pistons 12. Each of said pistons 12 is provided in its radially outer area with a recess 12*d* for receiving a bearing means 13 together with a cylindrical roller 14. The rollers 14 are adapated to be supported by a cam path 17 provided by the cam disc 3. In their radially lower area, each of the pistons 12 comprises a circular groove 12*c* for receiving a piston ring 20 as a sealing element. Piston chambers formed by said bores 11 are connected via axially extending bores 21 with axially extending control bores 22, 23, provided in a control sleeve 24. The control sleeve 24 is located in the stationary housing half 2. The control sleeve 24 defines circumferentially extending control spaces 25 and 26, which are connected to the ports of a pressure source and a tank, respectively. Neither the pressure source nor the tank are shown. Depending on the position of the piston chambers 11 with respect to said control bores 22 and 23, the piston chambers are either connected to the pressure source or to the tank, so that a rotary moment is acting upon the rotor 10 which is then transmitted via the multi groove connection to the drive shaft 5. As is shown in FIGS. 3 through 5 the bores 11 of the rotor, which are adapted to receive the pistons 12, are each provided with four recesses 11*a* adapted to receive roller sections 14*a*. The recesses 11*a* are formed by circumferentially extending grooves 15 in the rotor 10 and are thus a part of the grooves 15. The grooves 15 are dimensioned such that their outer walls 15*a* also form the axial guide means for the side surfaces 14*b* of said rollers 14. The length of the rollers is basically irrelevant. The longer the rollers, the longer has to be the depth of the grooves 15 on both sides. A good compromise is achieved if the length of the roller is about 0.9 to 0.95 times the diameter of the piston. The depth of the circumferentially extending grooves 15 can be reduced in as much as the roller can partially be inserted in the existing piston bore.

Turning now to the embodiment of the invention shown in FIGS. 6 and 7 it should be noted that the invention specifically relates to a radical piston motor which has a basic design as shown in FIGS. 1 to 5.

As is shown in FIGS. 6 and 7 the cylinder block (rotor) 110 comprises bores 111 adapted to receive pistons 112. Adjacent to each piston 112 a roller 114 is provided with a bearing means 113 therebetween. The roller 114 is adapted for engagement with a cam path 117 of the cam disc 103. Each piston 112 is provided with a piston ring 120. The piston 112 comprises in its lower area a recess 180. A connecting bore 121 provides a connection to the lower part of the bore in which the positon 112 is located.

In accordance with the invention detent means are provided for each piston 112. Said detent means are such that the piston 112 can be located in a specific radial position. Preferably, the detent means are provided such that the piston can be located in its lower dead point position. This is desirable, so as to provide for no engagement between the piston 112 (i.e. the piston and roller) and the cam path or cam curve 117.

Preferably, the detent means of the invention are arranged between the piston 112 and the respective roller means 114 and the rotor 110. It is also conceivable that said detent means is provided between said piston 112 and the cylinder block 110. However, for reasons of easy manufacturing the arrangement of the detent means between the roller 114 and the cylinder block 110 is preferred. The detent means comprises preferably for each piston 114 detent balls 181 and 182 which are located in recesses 183 and 184 of the roller 114. In a bore 200 connecting said recesses 183 and 184 a spring element 185 is located which biases both detent balls 181 and 182 axially outwardly towards the inner wall of the rotor 110.

In the area of the detent balls 181 and 182 detent recesses are formed in the rotor 110. Said detent recesses are preferably provided, as is shown, by axially extending bores 188, 189. The recesses 183 and 184 are located at the front surfaces or front sides 190, 191 of the roller 114. The two front surfaces 190 and 199 of the rollers 114 each comprise radially outwardly located tapers 192 and 193.

FIG. 6 discloses the piston 112 in its normal operating position in engagement with the cam path 117 of the cam disc 103. FIG. 7 shows the piston 112 in its detent position or snap-in position within the rotor or cylinder block 110, with the roller 114 being in its lower dead point position. With regard to the position of the bores 188 and 189 or the recesses cooperating with said detent balls 181, 182, they are provided in those parts of the cylinder block (rotor) which is used for guiding the rollers 114. With respect to the guidance of the rollers see FIGS. 4 and 5.

The detent or snap-in position of the piston 112 is only present for the lower dead point position of the piston 112. Here the balls 181 and 182 snap into the bores 188 and 189 of the cylinder wall. In all other positions of the piston, including the upper dead point position as is shown in FIG. 6, no-snap-in position is present for the piston 112. This means that during the normal operation of the engine or motor continuously snap-in actions occur whenever the lower dead point position is reached. However, said snap-in actions do not become effective during the normal operation of the motor.

We claim:

1. A radial piston motor comprising a housing having two housing halfs, an annular cam disc fixedly mounted between said two housing halfs, a shaft extending into said housing, a cylinder block mounted to said shaft and arranged for rotation together with said shaft within said housing, a plurality of bores in said cylinder block each extending radially that with respect to the axis of rotation of said shaft, a plurality of pistons reciprocally mounted in said bores, cylindrical rollers supported in said pistons and adapted to be in engagement with a cam path provided by said cam disc, and snap-in means provided between said rollers and portions of the cylinder block adapted for guiding said rollers, wherein said snap-in means comprise spring biased ball means in said rollers and, cooperating there-with, recesses in said cylinder block, said recesses in said cylinder block being arranged such, that said spring biased balls will snap into said recesses when said piston is in its lower dead point position.

2. A radial piston engine comprising:

a housing;

an annular cam fixedly mounted to said housing;

a cylinder block rotatably mounted about an axis with respect to said cam disc;

a plurality of bores in said cylinder block extending radially with respect to the axis of rotation;

a plurality of pistons reciprocally mounted within said bores;

cylindrical rollers for providing support for the pistons on the cam path provided by said cam disc, said rollers having axes extending parallel to said axis of rotation of said cylinder block; and detent means adapted to provide a snap-in action for said piston within said cylinder block;

wherein said detent means acts between front surfaces of said rollers and said cylinder block.

3. The radial piston engine of claim 2 wherein said detent means acts between the front surfaces of the roller and portions of the cylinder block adapted for guiding said rollers (114).

4. The radial piston engine of claim 2 wherein said detent means comprises spring loaded detent balls in said rollers and recesses in parts of the cylinder block adapted for guiding said rollers, said recesses being adapted to receive said spring loaded detent balls.

5. The radial piston engine of claim 4 wherein said recesses for said detent balls are arranged at a location of said cylinder block where said rollers are in their lower dead point position.

6. The radial piston engine of claim 2 wherein the engine is a motor.

* * * * *